US005934528A

United States Patent [19]

Higuchi

[11] Patent Number: 5,934,528

[45] Date of Patent: Aug. 10, 1999

[54] WAIST BAG USABLE AS A BABY HOLDER

[75] Inventor: Junichi Higuchi, Gifu, Japan

[73] Assignee: Lucky Industry Company, Ltd., Gifu, Japan

[21] Appl. No.: 09/045,107

[22] Filed: Mar. 20, 1998

[30] Foreign Application Priority Data

May 22, 1997 [JP] Japan ..... 9-132573

[51] Int. Cl.[6] ..... A45F 4/02

[52] U.S. Cl. ..... 224/159; 224/161

[58] Field of Search ..... 224/161, 160, 224/159, 158

[56] References Cited

U.S. PATENT DOCUMENTS 5,641,101 6/1997 Nakayama ..... 224/159

5,657,915 8/1997 Nakayama ..... 224/159

FOREIGN PATENT DOCUMENTS 3003744 11/1994 Japan .

*Primary Examiner*—Linda J. Sholl

*Attorney, Agent, or Firm*—Armstrong, Westerman, Hattori, McLeland & Naughton

[57] ABSTRACT

A waist bag usable as a baby holder includes a waist bag body capable of supporting the weight of a baby seated thereon and a waist belt secured to the waist bag body for fixing the waist bag body to a user's waist. A shoulder strap is capable of being suspended from the user's shoulder or neck when the user holds a baby seated on the waist bag body. Both ends of the shoulder strap are connected to the waist bag body. An auxiliary strap is bridged across the shoulder strap for holding an upper part of a baby. A distance between the auxiliary strap and the waist bag body can be adjusted at both ends of the auxiliary strap, independently. Therefore, a baby can always be held by the auxiliary strap despite the baby holding position, the physique of the user or the physique of the baby.

13 Claims, 9 Drawing Sheets

WAIST BAG USABLE AS A BABY HOLDER

BACKGROUND OF THE INVENTION

1. Field of the Invention

The present invention relates to a waist bag usable as a baby holder.

2. Description of the Related Art

Conventional waist bags of this kind are known to the public, as disclosed, for example, in the Japanese Utility Model Registered Publication No. 3003744. The waist bag comprises a waist bag body reinforced with a rigid plate core disposed under a top sheet of the waist bag body, a waist belt secured to the waist bag to be fastened to a user's waist, a shoulder strap connected to the waist bag body and an auxiliary strap having both ends sewn to the corresponding portions of the shoulder strap for holding a baby sitting on the waist bag body. When a user fastens the waist belt to his or her waist and suspends the shoulder strap from his or her shoulder or neck, this waist bag also serves as a baby holder allowing a baby to sit on the top sheet. In this state, the auxiliary strap holds the upper part of the baby.

In the above mentioned waist bag, to securely hold the baby, it is desirable that the auxiliary strap is horizontally positioned on the baby's back and under the baby's arms as high as possible.

It is, however, noted that certain drawbacks are inherent in those waist bags usable as baby holders, as will be detailed below.

When a user fastens the waist belt to his or her waist so as to locate the waist bag body on his or her right-front or left-front waist and suspends the shoulder strap from the user's opposite shoulder, i.e., left or right shoulder which is at an opposite side from the waist bag body, the length from the user's shoulder top to one of the lower ends of the shoulder strap located on the user's back is longer than that from the user's shoulder top to the other of the lower ends of the shoulder strap located on the user's front. As a result, the auxiliary strap inclines such that one end of the auxiliary strap located at the user's back side is positioned lower than the other end of thereof located at the user's front side, which causes a large gap between one of the baby's arms and one end of the auxiliary strap located at the user's back side, causing a lack of baby-holding stability.

Because the inclination degree of the auxiliary strap depends on a user's body size, even if an auxiliary strap is sewn to the shoulder strap in an inclined state so that the auxiliary strap can be kept horizontal when a user uses the waist bag, such inclination of the auxiliary strap is not necessarily useful to keep the auxiliary strap horizontal for other users having different body sizes.

Further, since these kinds of waist bags are preferably used for from a 6-month-old baby to a four-year-old infant, it is desirable that the height of the auxiliary strap can be changed in accordance with the growth of a baby so as to stably hold a baby despite the baby's growth. However, in a conventional baby holder, because an auxiliary strap is sewn to a shoulder strap, even if the height of the auxiliary strap is appropriate when the baby is at a younger age, the height of the auxiliary strap will become gradually lower as the baby grows up. On the other hand, if the auxiliary strap is set higher by anticipating the growth of a baby, the auxiliary strap will be too high when the baby is small in size. Thus, in a conventional baby holder, it was impossible to keep baby-support stability for a long period.

SUMMARY OF THE INVENTION

An object of the present invention is, therefore, to provide a waist bag usable as a baby holder which can stably hold a baby with an auxiliary strap kept horizontal even if various kinds of users having different sizes or shapes wear the waist bag with its waist bag body positioning at his or her right or left waist, and even if a baby changes in size or shape in accordance with its growth.

To attain the foregoing, a waist bag usable as a baby holder according to the present invention includes a waist bag body capable of supporting the weight of a baby seated thereon, a waist belt secured to the waist bag body for fixing the waist bag body to a user's waist, a shoulder strap capable of being suspended from the user's shoulder or neck when the user holds a baby seated on the waist bag body, both ends of the shoulder strap being connected to the waist bag body, and an auxiliary strap for holding an upper part of the baby, the auxiliary strap being bridged across the shoulder strap, wherein a distance between the auxiliary strap and the waist bag body can be adjusted at both ends of the auxiliary strap, independently.

In the waist bag usable as a baby holder according to the present invention, because the height of the auxiliary strap can be independently adjusted at right or left sides thereof, the auxiliary strap can be adjusted to stay horizontal despite the baby holding position or the user's physique or baby's physique. Further, the auxiliary strap can be positioned higher at both right and left ends thereof in accordance with the growth of a baby. Therefore, a baby can safely be held by an auxiliary strap despite the baby holding position or the user's physique or baby's physique.

The waist bag may further include a backing connected to the lower ends of the shoulder strap for supporting a lower part of a baby seated on the waist bag body from outside of the baby. This enables a user to safely hold the lower part of the baby.

The shoulder strap may be connected to the waist bag body by way of the backing.

The backing may be connected to the waist bag body by way of a connecting belt.

The auxiliary strap may be, at its both ends, fixed to the shoulder strap, and the shoulder strap may be adjustable in length at its both lower portions located lower than the auxiliary strap.

The auxiliary strap may be, at both ends, fixed to the shoulder strap, and the shoulder strap may be divided, at each lower portion located lower than the auxiliary strap, into an upper divided portion and a lower divided portion, and the upper divided portion and the lower divided portion may be connected by way of a ladder member so as to adjust the length of the lower portion. This enables a fine adjustment of the height of the auxiliary strap to keep the auxiliary strap more precisely horizontal and to maintain an easy adjustment of the height of the auxiliary strap.

The waist bag may further include an auxiliary belt connected to the auxiliary strap for winding around an upper part of a baby. This enables a user to hold a baby more safely.

The auxiliary belt may have two ends which are detachably connected with each other by way of a buckle.

Both ends of the auxiliary strap may be selectively engaged with a plurality of engaging members provided along the shoulder strap. This also enables the auxiliary strap to stay horizontal in the same way when a ladder member is used as described above, and also enables the auxiliary strap to be washed or replaced.

Other objects and features will be apparent from the following detailed description of the invention with reference to the attached drawings.

BRIEF DESCRIPTION OF THE DRAWINGS

The present invention will be more fully described and better understood from the following description, taken with the appended drawings, in which:

FIG. 7A shows the waist bag disposed at a right side of the user's waist, and FIG. 7B shows the waist bag disposed at a left side of the user's waist;

DETAILED DESCRIPTION OF THE PREFERRED EMBODIMENT

Figure 1:
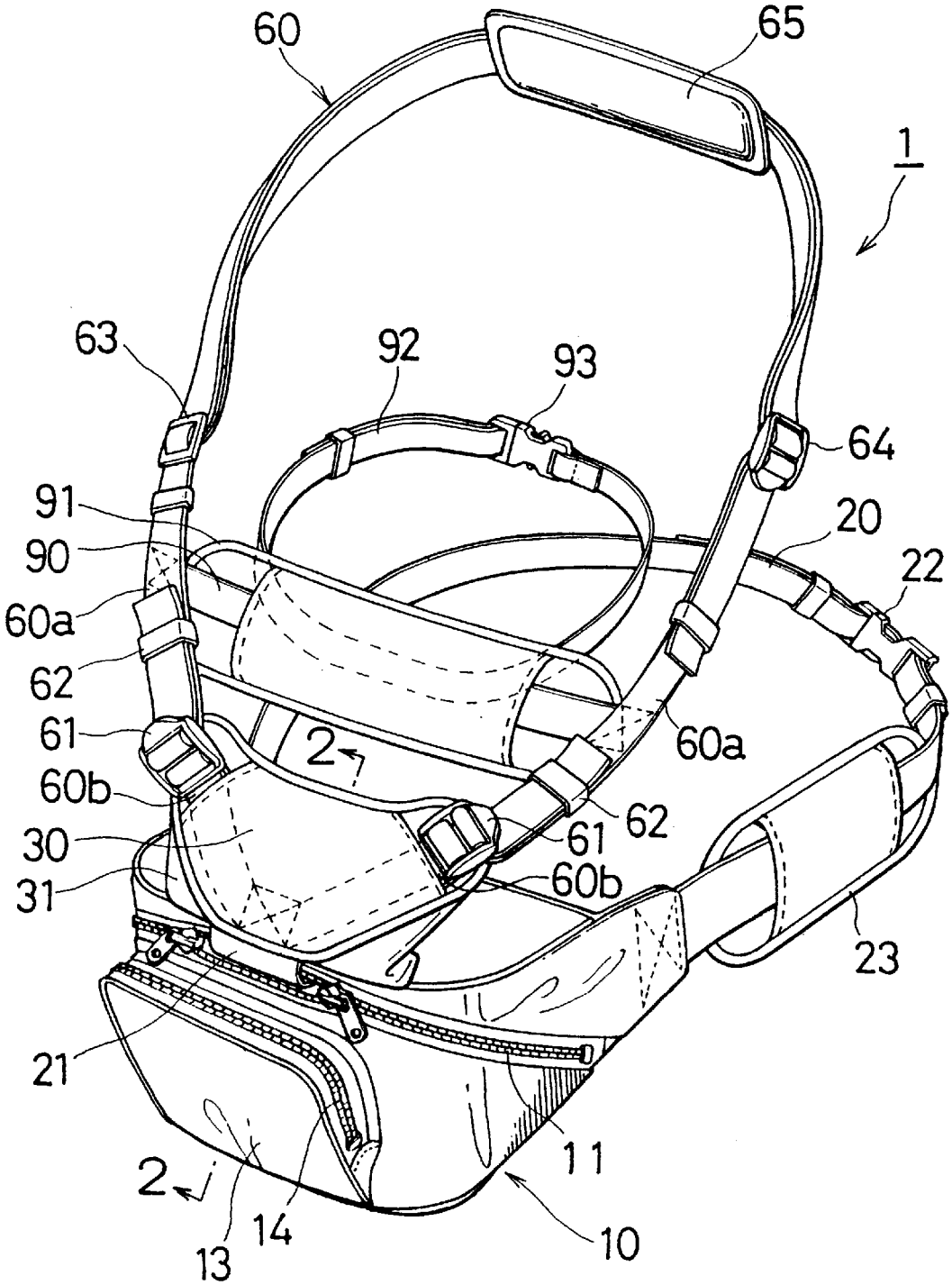
FIG. 1 is a perspective view of a waist bag usable as a baby holder, shown in its entirety, in a preferred embodiment according to the present invention.

A preferred embodiment of the present invention will now be described, in detail, with reference to the accompanying drawings.

FIGS. 1 to 6 show an embodiment of a waist bag usable as a baby holder 1 according to the present invention. The waist bag usable as a baby holder 1 includes a waist bag body 10 in which a supporting member 40 is disposed. A waist belt 20 has opposite ends secured to the waist bag body 10. A shoulder strap 60 is connected to the waist bag body 10 by way of a connecting belt 21 and a backing 30 secured to the lower ends of the shoulder strap 60. And, an auxiliary strap 90 bridges between corresponding sides of the shoulder strap 60.

Figure 2:
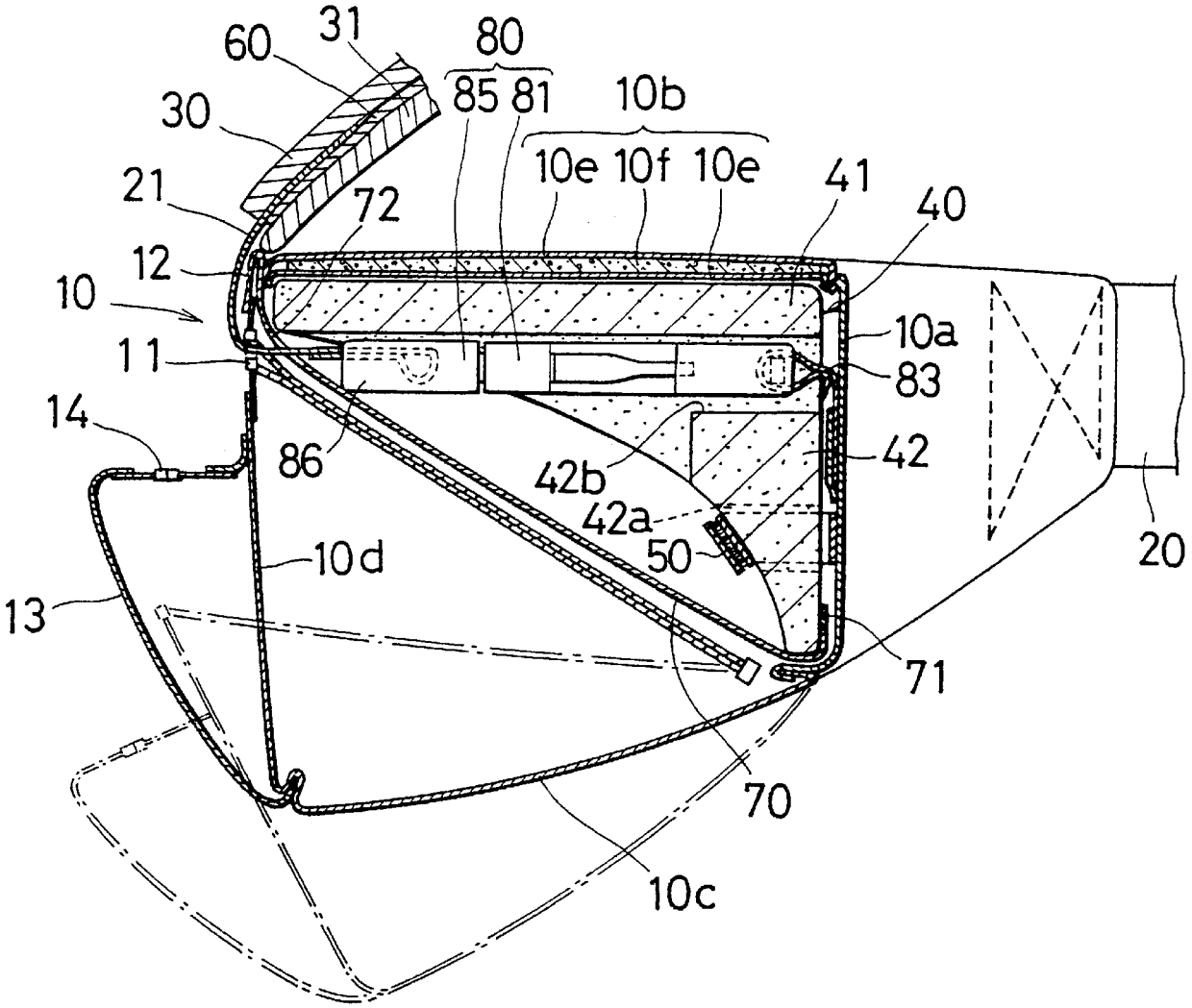
FIG. 2 is an enlarged cross-sectional view taken along the line 2—2 in FIG. 1.

As shown in FIG. 2, the waist bag body 10 is composed of a rear sheet 10*a* which is rectangular and longer in a sideways direction, top and bottom sheets 10*b* and 10*c* which extend from upper and lower edges of the rear sheet 10*a*, respectively, and a front sheet 10*d* which defines front and side faces of the waist bag body 10. A front portion of the waist bag body 10 protrudes convexly forward.

The top sheet 10*b* comprises a pair of upper and lower sheets 10*e*, 10*e* and a cushiony thin sheet 10*f* interposed therebetween.

As shown in FIG. 2, a main mouth 11 which is closable with a zipper is formed in the front sheet 10*d*. The mouth 11 is arch-shaped and has a central region formed in an upper middle portion of the front sheet 10*d*. Side or feet regions of the mouth 11 extend from the central region toward lower and rear ends of the opposite sides of the waist bag body 10. Each side region of the mouth terminates at a location close to a boundary between the front sheet 10*d* and the rear sheet 10*a*. Such a design of the mouth 11 is advantageous in that when the zipper is unfastened, the front sheet 10*d* can swing almost entirely together with the bottom sheet 10*c* backward and downward about a rear end thereof, as shown with a phantom lines in FIG. 2, whereby the mouth 11 opens wide. Thus, a shoulder strap 60 and/or small articles can be easily taken in and out.

The waist bag body 10 has a skirt portion 12 extending downward from the front periphery of the top sheet 10*b* for covering the front edge of the top sheet 10*b*. A pocket 13 for accommodating small articles is provided on the front face of the front sheet 10*d*. A mouth 14 is formed at the top of this pocket, and the mouth 14 is also operably closed with a zipper.

The waist belt 20 connected to the waist bag body 10 is adjustable in length, and has a buckle 22 operable to be closed to wear the bag body or to be opened to take off the waist bag body 10. Thus, the waist bag body 10 can be worn by fastening the waist belt 20 to a user's waist.

In FIG. 1, reference numeral 23 denotes a waist pad movably attached to the waist belt 20.

In the waist bag body 10, a supporting member 40 for supporting the weight of a baby seated on the top sheet 10*b* is disposed. The supporting member 40 is made of plastic materials such as hard polystyrene foam or the like. As shown in FIG. 2, the supporting member 40 comprises a seat portion 41 and a waist portion 42 formed integrally therewith so as to be of a generally reversed L-shape in cross-section. The seat portion 41 and the waist portion 42 are formed to correspond to the top sheet 10*b* and the rear sheet 10*a* in size and shape, respectively. A pair of belt-insertion apertures 42*a*, 42*a* having a vertical rectangular shape in cross-section are formed through lower right and left sides of the waist portion 42 in a direction of the thickness. Another buckle-insertion aperture 42*b* having a horizontal rectangular shape in cross-section is formed through an upper central portion in a direction of the thickness between the belt-insertion apertures 42*a*, 42*a* such that the upper inner surface of the aperture 42*b* extends to a lower front edge of the seat portion 41.

As shown in FIG. 2, the supporting member 40 is disposed in the waist bag body 10 such that the seat portion 41 and the waist portion 42 extend along the top and rear sheets 10*b* and 10*a*, respectively.

Figure 3:
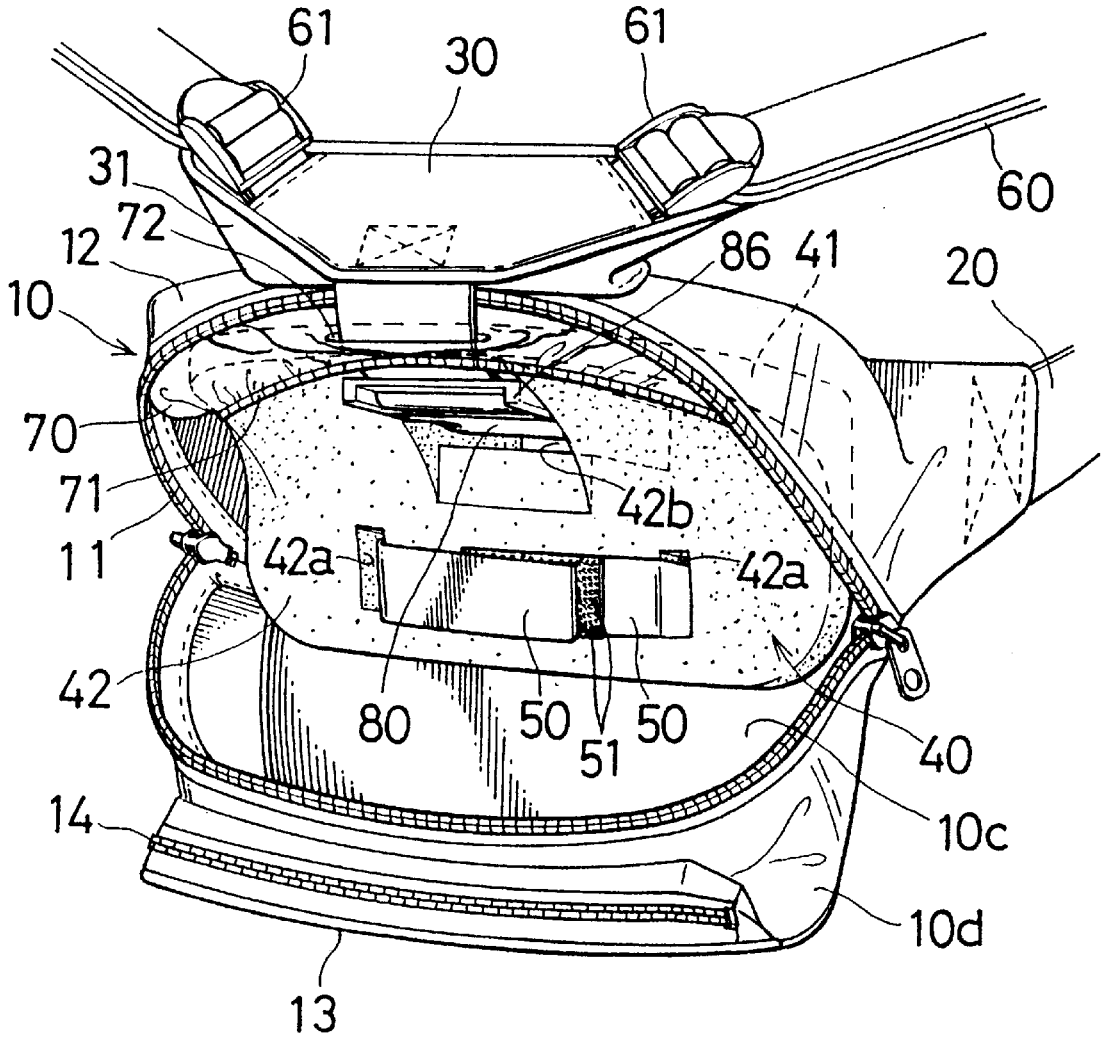
FIG. 3 is a perspective view of the waist bag body showing the inside through the mouth by turning up the inner cover.

The supporting member 40 is detachably fastened to the waist bag body 10 by a fastening band 50, as shown in FIGS. 2 and 3. The band 50 has a central portion fixed to a lower central portion of the rear sheet 10*a* and lateral end portions passed through corresponding belt-insertion apertures 42*a* and 42*a*. Both lateral end portions of the fastening band 50 are overlapped and detachably fastened by flat-shaped fastening members 51, 51 (e.g., with hook and loop fasteners) fixed on corresponding surfaces of the lateral end portions so as to steadily hold the supporting member 40 in the waist bag body 10.

In the buckle-insertion aperture 42*b* of the supporting member 40, a female portion 81 of a buckle 80 is disposed to be placed under the seat portion 41, and is fixed to the rear sheet 10*a* by way of a belt 83.

Figure 4:
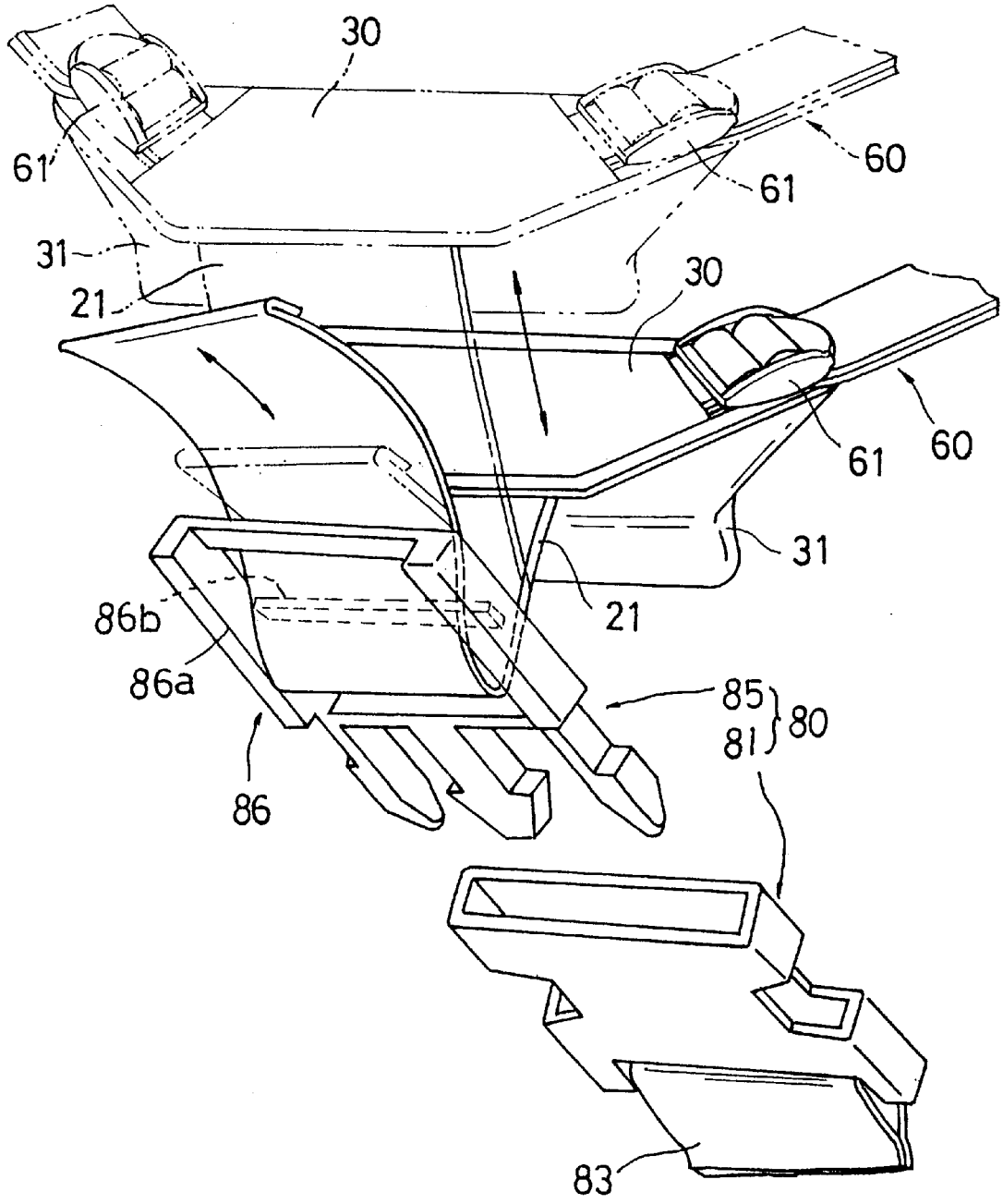
FIG. 4 is a perspective view of a portion of the device showing a buckle in a disassembled state.

As shown in FIG. 4, a male portion 85 of the buckle 80 is integrally provided with a ladder portion 86 for connecting the connecting belt 21 so as to adjust the length thereof. The ladder portion 86 includes a rectangular frame 86*a* and a bridge portion 86*b* crossed over the rectangular frame 86*a*.

As shown in FIG. 3, an inner cover 70 for covering a front surface of the supporting member 40 is provided within the waist bag body 10. The upper periphery of the cover 70 is sewn to the inner upper portion of the skirt portion 12, and the rest of the periphery, namely lower periphery of the cover 70, is provided with an elastic belt 71. The cover 70 extends over the supporting member 40 by hanging the lower end portion of the cover 70 on the lower edge of the waist portion 42, as shown in FIG. 2. An upper central portion of the inner cover 70 has a connecting belt insertion-aperture 72 corresponding to the buckle-insertion aperture 42*b*.

As shown in FIG. 2, the connecting belt 21 is inserted through the connecting belt insertion-aperture 72 of the inner cover 70, with one end of the connecting belt 21 sewn to the shoulder strap 60 and the other end thereof disposed in the inner cover 70. As shown in FIG. 4, the other end of the connecting belt 21 is inserted into the rectangular frame 86*a* of the ladder portion 86 so as to be engaged with the bridge portion 86*b*. Thus, the connecting belt 21 can be held by the ladder portion 86 at any desired position, enabling the adjustment of the length according to the growth of the baby.

As shown in FIG. 1, the shoulder strap 60 has a loop-shaped upper portion and lower ends connected to the connecting belt 21 to be connected to the waist bag body 10. A generally reversed triangle-shape backing 30 is disposed at the lower portions of the shoulder strap 60 and sewed to the upper portion of the connecting belt 21. A pad 31 for protecting the feet of the baby seated on the waist bag body 10 when facing forward is sewn to the inside surface of the backing 30. Above the backing 30, the auxiliary strap 90 is bridged across the shoulder strap 60 with both ends of the auxiliary strap 90 sewn to the opposite sides of the shoulder strap 60.

The shoulder strap 60 is, at right and left lower portions below the auxiliary strap 90, divided into a long strap 60*a* and a short strap 60*b*, respectively. The long and short straps 60*a* and 60*b* are each connected to respective ladder members 61 so as to be adjusted in length.

Figure 5:
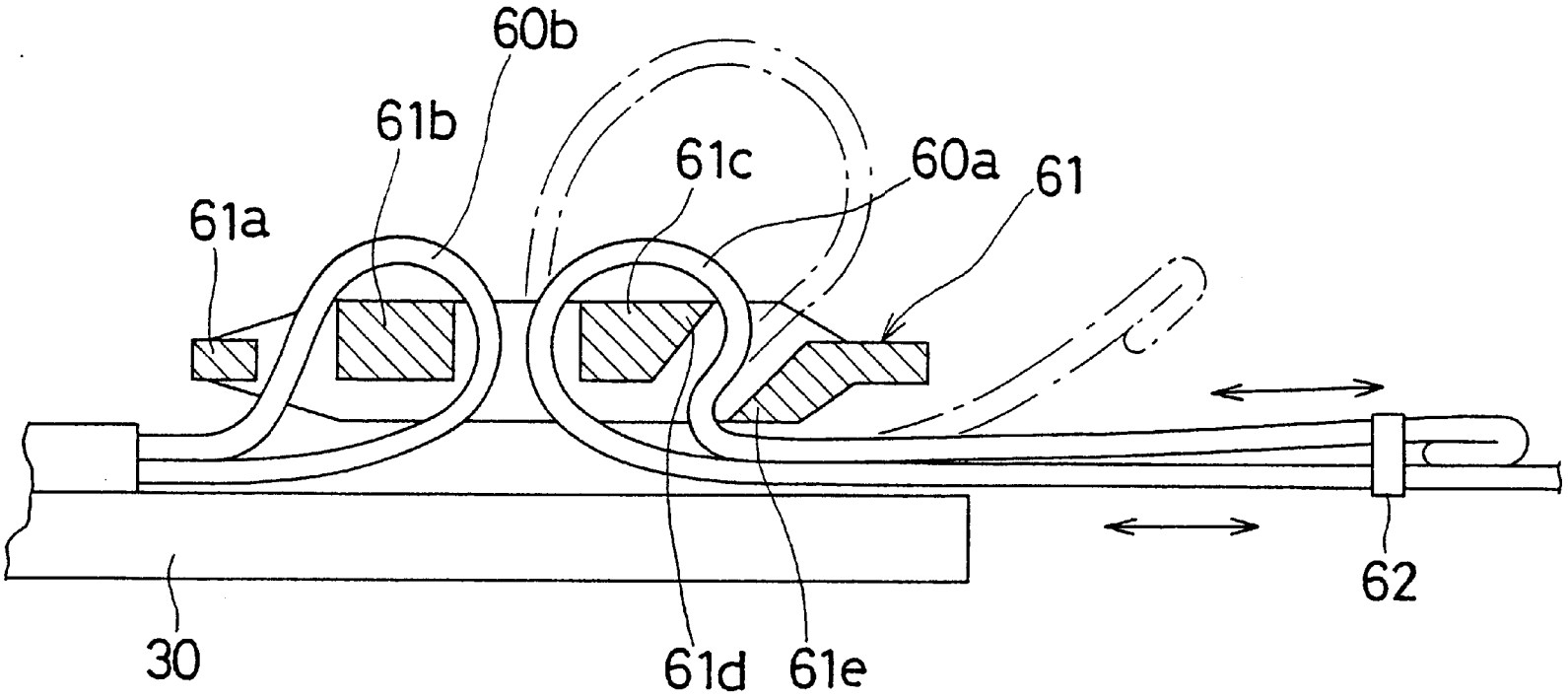
FIG. 5 is a vertical cross-sectional view of a ladder member which is used for adjusting the height of an auxiliary strap of the waist bag.

As shown in FIG. 5, each ladder member 61 has a rectangular frame 61*a*, a rectangular bridge portion 61*b* for fixing the short strap 60*b* and a trapezoid bridge portion 61*c* for fixing the long strap 60*a*. Both the bridge portions 61*b*, 61*c* are parallel with each other, and are bridging to the side portions of the frame 61*a*. The ladder member 61 is fixed to the short strap 60*b* which is wound around the rectangular bridge portion 61*b* and is sewn to form a loop. As shown with phantom lines in FIG. 5, the long strap 60*a* is wound around the trapezoid bridge portion 61*c* to be adjusted in length. In this manner, when the shoulder strap 60 is pulled against the short strap 60*b*, the long strap 60*a* engages with an acute edge portion 61*d* of the trapezoid bridge portion 61*c* and an acute edge portion 61*e* of the rectangular frame 61*a*. The free end of the long strap 60*a* is held on the strap by a keeper 62. The right and left ladder members 61 enable a user to adjust the length of the long strap 60*a* between the backing 30 and the auxiliary strap 90. In other words, the height of the auxiliary strap 90 can be adjusted at right hand and left hand sides thereof, separately. The whole length of the shoulder strap 60 can be roughly adjusted by an adjuster 63 provided on the long strap 60*a*, and can also be exactly adjusted by a ladder member 64 similar to the ladder member 61. In FIG. 1, reference numeral 65 denotes a shoulder pad attached to the shoulder strap 60.

The auxiliary strap 90 is bridged over the shoulder strap 60 with both ends of the auxiliary strap 90 sewn to the corresponding portions of the shoulder strap 60. The auxiliary strap 90 can be adjustable in length in accordance with a baby's size by way of a ladder member (not shown) along the length thereof similar to the ladder member 61. The auxiliary strap 90 is covered by a back pad 91 so as to avoid the hard ladder member (not shown) being touched directly. In the inner center portion of the back pad 91 is sewn an auxiliary belt 92 for wrapping around the upper part of a baby's body. The auxiliary belt 92 is, at its circumferential middle portion, provided with a buckle 93 which enables a user to connect and disconnect the belt and to freely adjust the length of the belt in accordance with a baby's size. The auxiliary belt 92 attached to the auxiliary strap 90 can securely hold a baby even if the baby moves on the waist bag body 10, thereby enhancing safety. The auxiliary belt 92 is preferably attached to the circumferential middle portion of the auxiliary strap 90 to fit well on the baby's body, which enhances the stability.

The waist bag 1 usable as a baby holder provided herein is used as follows when a baby is held on the right side or the left side of the user.

Figure 6:
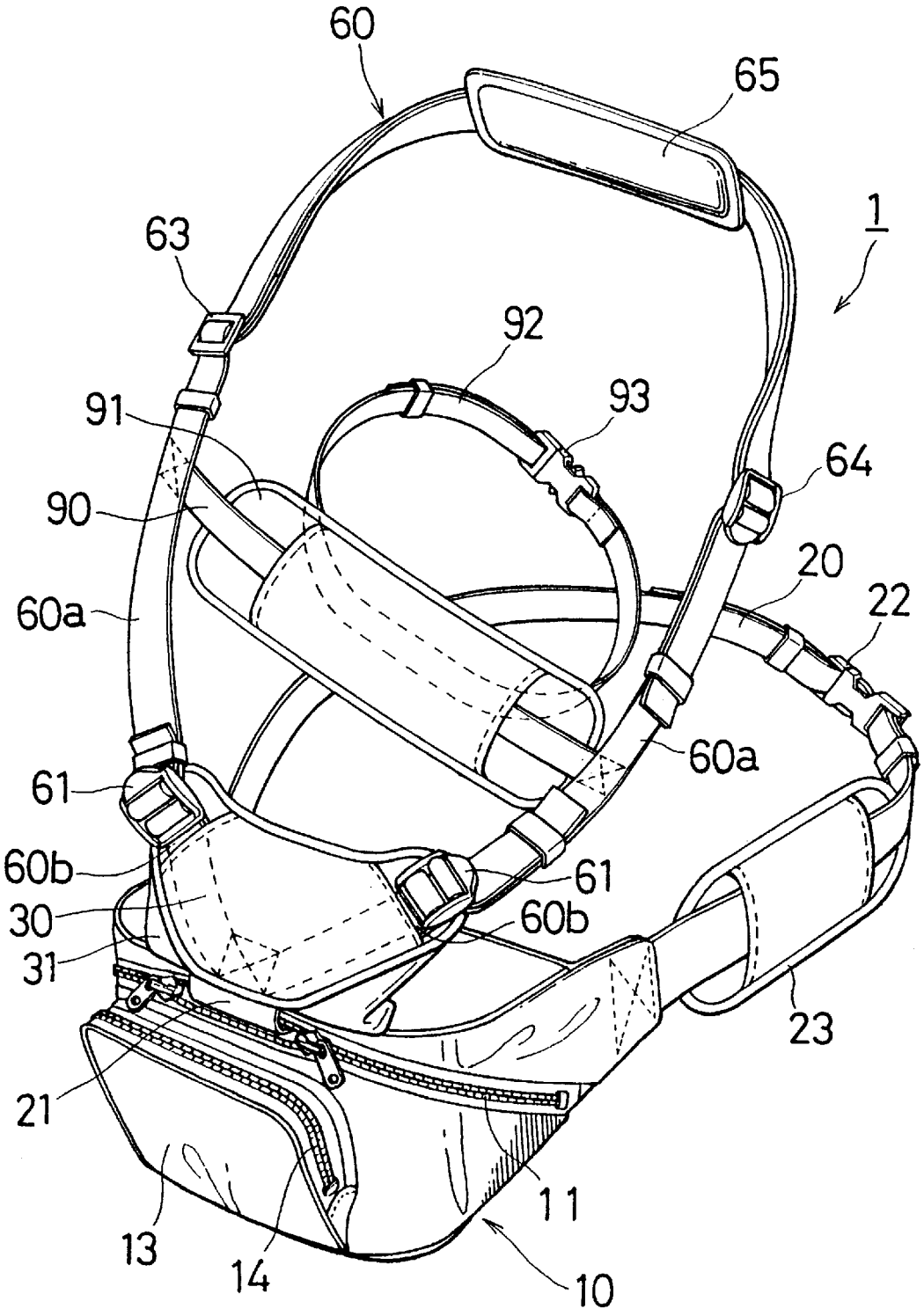
FIG. 6 is a perspective view of the waist bag in which the auxiliary strap is adjusted in height for holding a baby at a right side of the user's waist.

As shown in FIG. 6, depending on a baby-holding position, the auxiliary strap 90 is adjusted such that one end of the auxiliary strap 90 is positioned higher than the other end thereof by adjusting the right and left ladder members 61, each disposed between the long strap 60*a* and the short strap 60*b* of the shoulder strap 60. If the auxiliary strap 90 is adjusted to be horizontal, the auxiliary strap 90 declines toward the user's back when the waist bag body 10 is fitted on the user's right or left side. Therefore, the auxiliary strap 90 should be adjusted to decline such that the left end (as seen from the front) of the auxiliary strap 90 is positioned higher than the right end (as seen from the front) thereof when the waist bag body 10 is fitted on the user's right side, or such that the right end (as seen from the front) of the auxiliary strap 90 is positioned higher than the left end (seen from the front) thereof when the waist bag body 10 is fitted on the user's left side. This allows the auxiliary strap 90 to be parallel to the waist bag body 10 when in use, which in turn enables the user to hold a baby at a higher position under the baby's arms. FIG. 6 shows an example in which the auxiliary strap 90 is adjusted such that the left end (as seen from the front) of the strap 90 is positioned higher than the right end (as seen from the front) thereof. The inclination degree of the auxiliary strap 90 should be determined based on the baby's physique, the user's physique and/or the fitting position of the waist bag body 10. Because the ladder member 61 can lock the shoulder strap 60 at any position, the shoulder strap 60 can be exactly adjusted in length, enabling the shoulder strap 60 to have an appropriate length in accordance with the baby's physique or the user's physique. In use, for example, before wearing the waist bag usable as a baby holder the whole length of the shoulder strap 60 can be adjusted longer than that in use. Then, the user can first fit the waist bag body 10 on the user's waist and can fix the waist belt 20 to his or her waist.

Figure 7A:
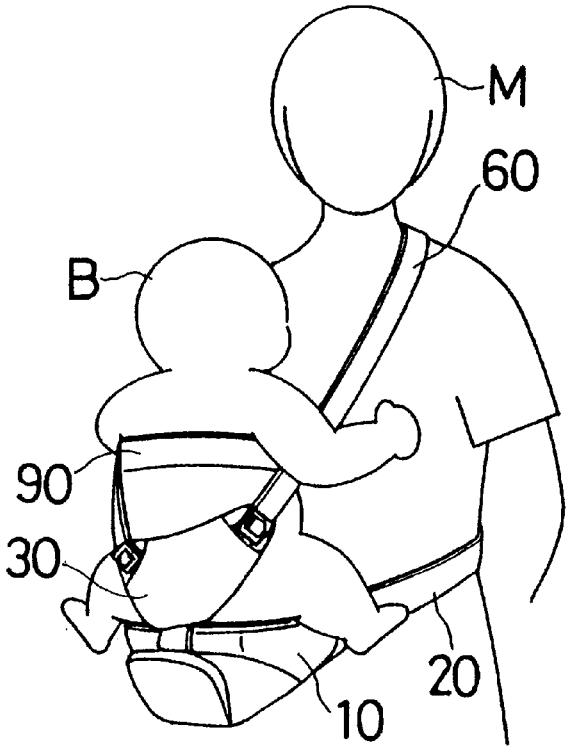
FIGS. 7A and 7B are perspective views of the waist bag in use.
Figure 7B:
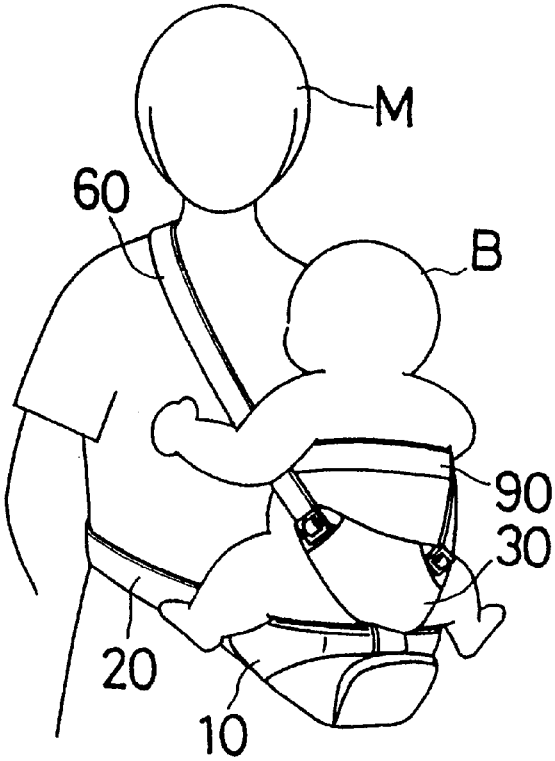

Thereafter, a baby is seated on the waist bag body 10 so as to face the user with the auxiliary belt 92 being wound around the upper part of the baby's body. The user will then suspend the shoulder strap 60 from his or her shoulder and exactly adjust the whole length of the shoulder strap 60 by the ladder member 64 so as not to sag the shoulder strap 60. In FIGS. 7A and 7B showing the usage of the waist bag usable as a baby holder, the shoulder strap 60 is surely locked by each of the ladder members 61, 61, 64 because the shoulder strap 60 is stretched. The auxiliary strap 90 holds the baby's back horizontally, which safely holds the baby in a steady position. FIG. 7A shows the waist bag disposed at a right side of the user's waist with the left end (as seen from the front) of the auxiliary strap 90 being positioned higher than the right end thereof. FIG. 7B shows the waist bag disposed at a left side of the user's waist with the right end (as seen from the front) of the auxiliary strap 90 being positioned higher than the left end thereof.

Figure 8:
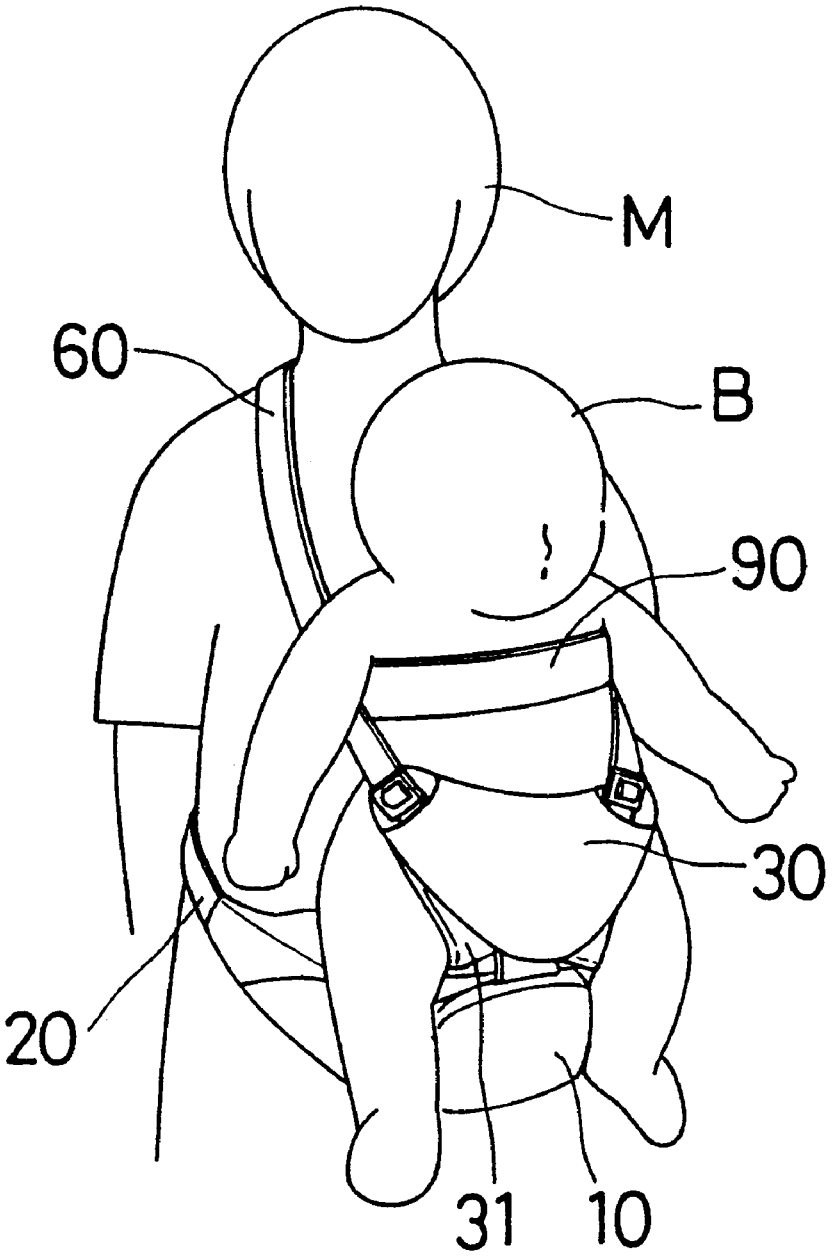
FIG. 8 is a perspective view of the waist bag used to hold a baby in front of the user.

As described above, in the waist bag usable as a baby holder 1, because the height of the auxiliary strap 90 can be independently adjusted at right or left side thereof, the auxiliary strap 90 can be kept in a horizontal state despite the baby holding position, or the user's M physique or the baby's B physique. This also enables the user to hold the baby B in a steady state, enhancing safety. Steadily holding a baby can reduce the user's burden. A horizontally positioned auxiliary strap 90 enables a user to hold a baby in a forward-directed position, as shown in FIG. 8. In this holding state, since the baby's legs are positioned outside the backing 30, the cushiony pad 31 formed along the outside portion of the backing 30 can protect the baby's crotch.

When the waist bag is used as a normal waist bag, namely when it is unnecessary for the user to carry his or her baby, the shoulder strap 60 can be placed in the waist bag body 10 which is fixed to the user's waist. In this state, it is possible for the user to hold his or her baby seated on the waist bag body 10 for a short time. When the shoulder strap 60 is not used, the shoulder strap 60 can be detached from the waist bag body 10 by disconnecting the male portion 85 of the buckle 80 which is connected to the connecting belt 21 from the female portion 81 of the buckle 80, and the supporting member 40 can also be taken out from the waist bag body 10 by unfastening the fastening band 50. As a result, the waist bag body 10 has enough space for accommodating small articles.

In the described preferred embodiment, the shoulder strap 60 can be placed in the waist bag body 10, and the connecting belt 21 connecting the shoulder strap 60 to the waist bag body 10 can be adjusted in length and can be detached from the waist bag body 10. However, this invention is not limited to the above. Although the ladder member 61 for adjusting the height of the auxiliary strap 90 is fixedly attached to the short strap 60*b* of the shoulder strap 60, the ladder member 61 may be fixedly attached to the long strap 60*a* so as to allow the adjustment of the length of the short strap 60*b*.

Figure 9:
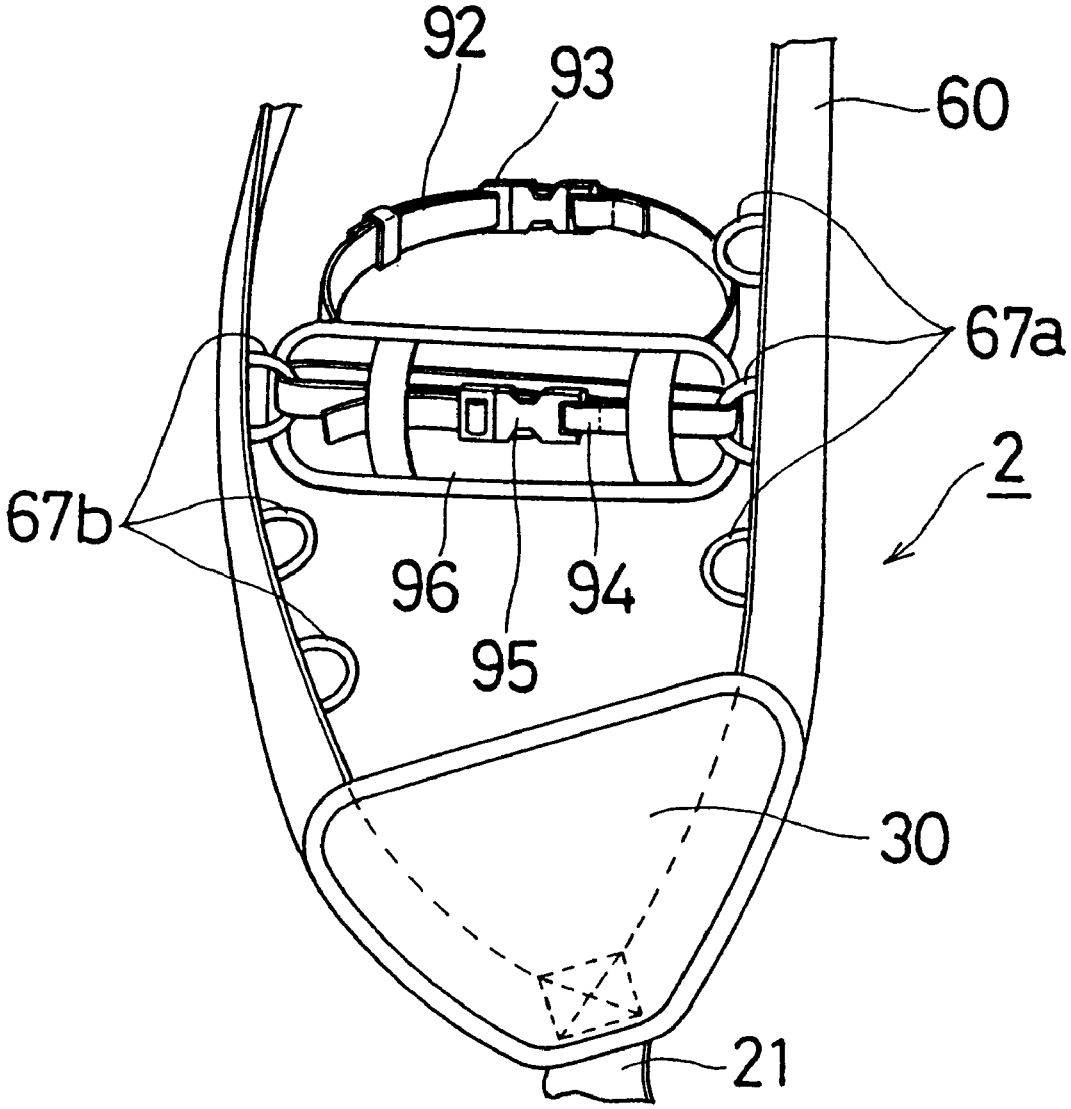
FIG. 9 shows an auxiliary strap in another embodiment according to the present invention.

FIG. 9 shows a main portion of an another embodiment of the waist bag usable as a baby holder 2 according to the present invention, which is different from the aforementioned waist bag usable as a baby holder 1 in an adjusting mechanism of the auxiliary belt. In the waist bag usable as a baby holder 2, the loop-shaped shoulder strap 60 has, at its portion above the backing 30, three pairs of loops 67*a*, 67*b* which are sewn to the shoulder strap 60 along the length thereof. An auxiliary strap 94 is formed to be a loop detached from the shoulder strap 60, and is also provided with a buckle 95 to detachably connect the auxiliary strap 94 and to adjust the length thereof. The auxiliary strap 94 can be connected to the shoulder strap 60 at any desired position by passing through the right and left loops 67*a*, 67*b* located at any position and connecting the buckle 95. In FIG. 9, the reference numeral 96 is a back pad to be attached to the auxiliary strap 94. The back pad 96 is provided with an auxiliary belt 92 similar to the auxiliary belt 92 described in the aforementioned embodiment.

In this embodiment, the auxiliary strap 94 can be adjusted in height at the right and left ends thereof, separately, enabling the auxiliary strap 94 to be kept horizontal. Because the auxiliary strap 94 can be detached from the shoulder strap 60, it is possible to clean only the auxiliary strap 94 and replace any broken parts of the auxiliary strap 94.

As mentioned above, in the waist bag usable as a baby holder according to the present invention, because the height of the auxiliary strap can be independently adjusted at right or left sides thereof by adjusting the distance between the auxiliary strap and the backing at right or left sides of the auxiliary strap, the auxiliary strap can be adjusted so as to be kept in a horizontal state despite the baby holding position, the user's physique or the baby's physique. Further, the auxiliary strap can be positioned higher at both right and left ends thereof in accordance with the growth of a baby. Therefore, a baby can always be safely held by an auxiliary strap despite the baby holding position, the use's physique or the baby's physique.

In such a case that ladder members are used to adjust the height of the auxiliary strap, the height can be adjusted finely, which can keep the auxiliary strap more precisely horizontal and also enables easy adjustment of the height of the auxiliary strap.

In such a case that both ends of the auxiliary strap are selectively engaged with a plurality of engaging members provided along the shoulder strap, the auxiliary strap can be detached from the shoulder strap, which enables the auxiliary strap to be kept horizontal in the same way as when a ladder member is used as described above. Further, the auxiliary strap itself can be washed or replaced.

Further, in such a case that an auxiliary belt for wrapping around the upper part of a baby is provided on the auxiliary strap, a baby can be held even more securely.

This application claims priority to Japanese Patent application No. Hei 9(1997)-132573, the disclosure of which is incorporated by reference in its entity.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A waist bag usable as a baby holder, comprising:

a waist bag body capable of supporting the weight of a baby seated thereon;

a waist belt secured to said waist bag body for fixing said waist bag body to a user's waist;

a shoulder strap capable of being suspended from the user's shoulder or neck when the user holds a baby seated on said waist bag body, both ends of said shoulder strap being connected to said waist bag body; and an auxiliary strap for holding an upper part of the baby, said auxiliary strap being bridged across said shoulder strap;

wherein a distance between said auxiliary strap and said waist bag body can be adjusted at both ends of said auxiliary strap, independently.

2. The waist bag as recited in claim 1, further comprising a backing for supporting a lower part of a baby seated on said waist bag body from outside, said backing being connected to the lower ends of said shoulder strap.

3. The waist bag as recited in claim 2, wherein said backing connects said shoulder strap to said waist bag body.

4. The waist bag as recited in claim 3, wherein said backing is connected to said waist bag body by way of a connecting belt.

5. The waist bag as recited in claim 1, wherein said auxiliary strap is, at its both ends, fixed to said shoulder strap, and wherein said shoulder strap is adjustable in length at lower portions located lower than said auxiliary strap.

6. The waist bag as recited in claim 1, wherein said auxiliary strap is, at its both ends, fixed to said shoulder strap, and wherein said shoulder strap is divided, at lower portions located lower than said auxiliary strap, into an upper divided portion and a lower divided portion, said upper divided portion and said lower divided portion are connected by way of a ladder member so as to adjust said lower portions in length.

7. The waist bag as recited in claim 1, further comprising an auxiliary belt for wrapping around an upper part of a baby, said auxiliary belt being connected to said auxiliary strap.

8. The waist bag as recited in claim 7, wherein said auxiliary belt has two ends, said ends being detachably connected with each other by way of a buckle.

9. The waist bag as recited in claim 6, further comprising an auxiliary belt for wrapping around an upper part of a baby, said auxiliary belt being connected to said auxiliary strap.

10. The waist bag as recited in claim 9, wherein said auxiliary belt has two ends, said ends being detachably connected with each other by way of a buckle.

11. The waist bag as recited in claim 1, wherein both ends of said auxiliary strap are selectively engaged with a plurality of engaging members provided along said shoulder strap.

12. A waist bag usable as a baby holder, comprising:

a waist bag body capable of supporting the weight of a baby seated thereon;

a waist belt secured to said waist bag body for fixing said waist bag body to a user's waist;

a shoulder strap capable of being suspended from the user's shoulder or neck when the user holds a baby seated on said waist bag body, both ends of said shoulder strap being connected to said waist bag body;

a backing connected to both lower ends of said shoulder strap;

an auxiliary strap for holding an upper part of the baby, said auxiliary strap being bridged across said shoulder strap; and an auxiliary belt for wrapping an upper part of a baby, said auxiliary belt being connected to said auxiliary strap;

wherein said auxiliary strap is, at both ends, fixed to said shoulder strap, and wherein said shoulder strap is divided at lower portions located lower than said auxiliary strap, into an upper divided portion and a lower divided portion, said upper divided portion and said lower divided portion are connected by way of a ladder member so as to adjust said lower portion in length.

13. The waist bag as recited in claim 12, wherein said auxiliary belt has two ends, said ends being detachably connected with each other by way of a buckle.

* * * * *